US010828796B2

(12) United States Patent
Schuman et al.

(10) Patent No.: US 10,828,796 B2
(45) Date of Patent: Nov. 10, 2020

(54) DEVICE FOR PUNCHING THIN-WALLED MATERIALS

(71) Applicant: Berhalter AG, Widnau (CH)

(72) Inventors: Dalibor Schuman, Widnau (CH); Markus Steiner, Rebstein (CH)

(73) Assignee: Berhalter AG, Widnau (CH)

( * ) Notice: Subject to any disclaimer, the term of this patent is extended or adjusted under 35 U.S.C. 154(b) by 243 days.

(21) Appl. No.: 15/571,385

(22) PCT Filed: Mar. 23, 2016

(86) PCT No.: PCT/CH2016/000050
§ 371 (c)(1),
(2) Date: Nov. 2, 2017

(87) PCT Pub. No.: WO2016/176784
PCT Pub. Date: Nov. 10, 2016

(65) Prior Publication Data

US 2019/0152088 A1 May 23, 2019

(30) Foreign Application Priority Data

May 6, 2015 (CH) ..... 623/15

(51) Int. Cl.
*B26F 1/44* (2006.01)

(52) U.S. Cl.
CPC ..... *B26F 1/44* (2013.01); *B26F 2001/4445* (2013.01); *B26F 2001/4463* (2013.01); *Y10T 83/2122* (2015.04); *Y10T 83/9307* (2015.04); *Y10T 83/9309* (2015.04)

(58) Field of Classification Search
CPC .... B26F 1/44; B26F 1/46; B26F 1/386; B26F 1/3853; B26F 2001/4472; B26F 2001/4463; B26F 2001/4445; B21D 37/205; Y10T 83/9452; Y10T 83/9307; Y10T 83/9444;
(Continued)

(56) References Cited

U.S. PATENT DOCUMENTS 3,635,115 A * 1/1972 Rickenbacher ..... B26D 7/2628 83/696
4,823,660 A 4/1989 Forthmann
2004/0045993 A1* 3/2004 Weinfurtner ..... B26D 7/025 225/2

FOREIGN PATENT DOCUMENTS

EP 1889696 A1 * 2/2008 ..... B26F 1/44
GB 2092502 8/1982
(Continued)

OTHER PUBLICATIONS

EP-1889696-A1 Engish translation; Feb. 2008; B26F1/44; Schuhmacher Alex.*

*Primary Examiner* — Laura M Lee
(74) *Attorney, Agent, or Firm* — Volpe Koenig

(57) ABSTRACT

A device by which thin-walled materials, such as labels and flat lids for containers, can be punched in micro or small quantities. The device includes a band steel cutting edge (11) that is elastically mounted in the punching direction. The matrix is likewise elastically held on the matrix plate perpendicular to the punching direction by virtue of a matrix seat (33) fastened to the region in the matrix plate (27) that is adjacent to the opening (29). On the matrix seat, an elastically deformable intermediate plate (47) is placed, and the matrix (55) is placed on the intermediate plate.

18 Claims, 8 Drawing Sheets

(58) Field of Classification Search
CPC .. Y10T 83/917; Y10T 83/9309; B65B 61/065
USPC ..... 83/123, 128, 696, 657, 640–641, 652, 83/685, 693; 76/107.8
See application file for complete search history.

(56) References Cited

FOREIGN PATENT DOCUMENTS

| | | | |
|---|---|---|---|
| JP | 2009107117 | 5/2009 | |
| NL | 1004864 C1 * | 6/1998 | ..... B26F 1/40 |

* cited by examiner 57
55
43
49
45
39
47

47
41
43
49
37
45
35
33
27

73
27

DEVICE FOR PUNCHING THIN-WALLED MATERIALS

BACKGROUND

The invention is directed to a device for punching thin-walled materials.

The punching of thin-walled materials, such as labels made from a tape comprising paper, plastic, metal foil, or laminate is known for example from U.S. Pat. No. 4,823,660 A. Such labels can also be used as flat lids of food containers, such as yoghurt and cream cups or on aluminum containers for canned goods. The labels, particularly those made from paper or thin plastic films, are also required for bottles, particularly beer, mineral water, and wine bottles. They represent mass-produced articles, which need to be punched in numbers measured not only in thousands or hundreds of thousands, but perhaps even in the millions. For such huge amounts the tool costs, i.e. the costs for the punching tool, are not very important, since usually the size and shape of the labels remain consistent for many years. Potential changes in design, i.e. the printing, have no influence upon the punching process and the costs thereof, and consequently expenses arise only during the printing process of the linear source material prior to punching, however they are not influential for the tool costs.

In addition to these labels or lids, produced in huge numbers and always identical, there is also a market for small quantities, perhaps only a few hundred or thousand units. For niche operations, such as small businesses like bakeries, butchers, or containers produced in only small numbers, which need to be labeled, although the high-output punching tools, usually operating in a rotary fashion, are not useful because their procurement and/or adjustment of the punching tools results in very high costs.

It is also known from JP2009107117 A to sever multi-layered laminates via a cutting blade. Such multi-layered laminates are compressed during the cutting process, so that it is required that the blade support for the cutting blade is embodied in a locally fixed manner in the z-direction. In this solution it may be disadvantageous that the cutting blades wear quickly, because they impinge the cutting support after each cutting process. In principle it is known from GB 2 092 502 A to use a spring-loaded cutting support; however, this cutting support can only be used for severing packaging films for articles, which are transported via a horizontal conveyer belt to the cutting device, and then are moved away from the cutting device via a transportation device in the horizontal direction, i.e. in the normal direction in reference to the cutting direction. The spring-loaded cutting support blocks any potential recess in the matrix plate, so that punched work pieces, such as labels or lids, cannot be removed in the cutting direction after the punching process.

SUMMARY

The objective of the present invention comprises now to provide a device for punching small quantities of labels and lids, e.g., on high-output punching machines. In other words, the objective comprises to embody a punching device such that it can be produced in a cost-effective fashion and instead of expensive high-output punching tools, and it can still be used on existing high-power punching machines, and the cutting tools are subject to little wear in order to limit to a minimum any expensive maintenance work at the punching tool.

This objective is attained in a device with the one or more features of the invention. Advantageous embodiments of the device are described below and in the claims.

A device for punching thin-walled materials, such as labels and flat lids for containers in micro and small quantities comprises a punching plate for accepting a blade and a matrix on a matrix plate, allowing the blade and the matrix to be fastened at a punching machine and supported in a mutually displaceable fashion, in order to punch labels and lids made of paper, plastic, metal, or a laminate from a material tape guided therebetween. The matrix plate for supporting the matrix comprises a recess for guiding through it the punched-out work pieces, such as labels or lids. A matrix seat is fastened on the edge section abutting the recess in the matrix plate such that an elastic, deformable intermediate plate is placed on the matrix seat, with the matrix resting on the intermediate plate. The matrix may be guided without play in the x and y-directions by fastening pins, and held in the z-direction guided in an elastically displaceable fashion.

According to one exemplary embodiment the matrix seat may be inserted and fastened in a step surrounding the recess.

According to one exemplary embodiment the intermediate plate and the matrix thereabove can be placed on the matrix seat and held in a guided fashion by the fastening pins. In particular, the fastening pins may be guided in guide sleeves, which are inserted in the matrix seat. In particular, magnets can be used in the guide sleeves for contracting the fastening pins and holding the matrix.

According to one exemplary embodiment the intermediate plate is embodied in an elastic fashion and perpendicular in reference to its surface and shows a surface coated with at least one elastic material, such as rubber, or is made in its entirety from an elastic material.

According to one exemplary embodiment a recess may be formed in the punching plate. In particular, a spring-elastic compensation element may be inserted at the bottom of a groove comprising the recess. A blade holder may be arranged above the compensation element in said groove. In particular, the blade holder may be embodied in a U-shaped fashion. The blade holder may comprise a first and a second leg, with a band steel blade perhaps being inserted between the legs of the U-shaped blade holder, with the blade edge perhaps projecting beyond the blade holder. The blade holder may rest elastically in the groove on the compensation element and be fastened in the groove by holding elements, which engage the punching plate.

According to one exemplary embodiment a compensation element may be inserted at the bottom of a groove comprising the recess. A magnetic blade support may be arranged above a compensation element in the groove, arranged like a support ring. Above the support ring a support plate may rest with a bead embodied thereon as the blade and held by the magnetic support ring. According to one variant a plurality of magnets may be inserted in the support ring, by which the support plate with the cutting bead can be held.

According to one exemplary embodiment at least one ejection device with an ejection plate is arranged at the punching plate, by which punched out work pieces can be ejected through the recess in the matrix plate into a stacking channel.

The use of blades made from band steel, known per se, which are shaped in the form of the perimeter of the label to be punched, allows punching out labels. Such band steel tools are extremely cost-effective in their production. Accordingly, if the shape or size of lids for containers on which the labels are to be applied is altered, within a few days new dies can be produced, which can generate the new or altered label form. The matrix as well, which is required for punching with the band steel tool, can be produced in a very cost-effective fashion, because it alone surrounds a relatively thing steel plate.

BRIEF DESCRIPTION OF DRAWINGS

Based on an illustrated exemplary embodiment the invention is explained in greater detail. It shows.

DETAILED DESCRIPTION OF THE PREFERRED EMBODIMENTS

Figure 1:
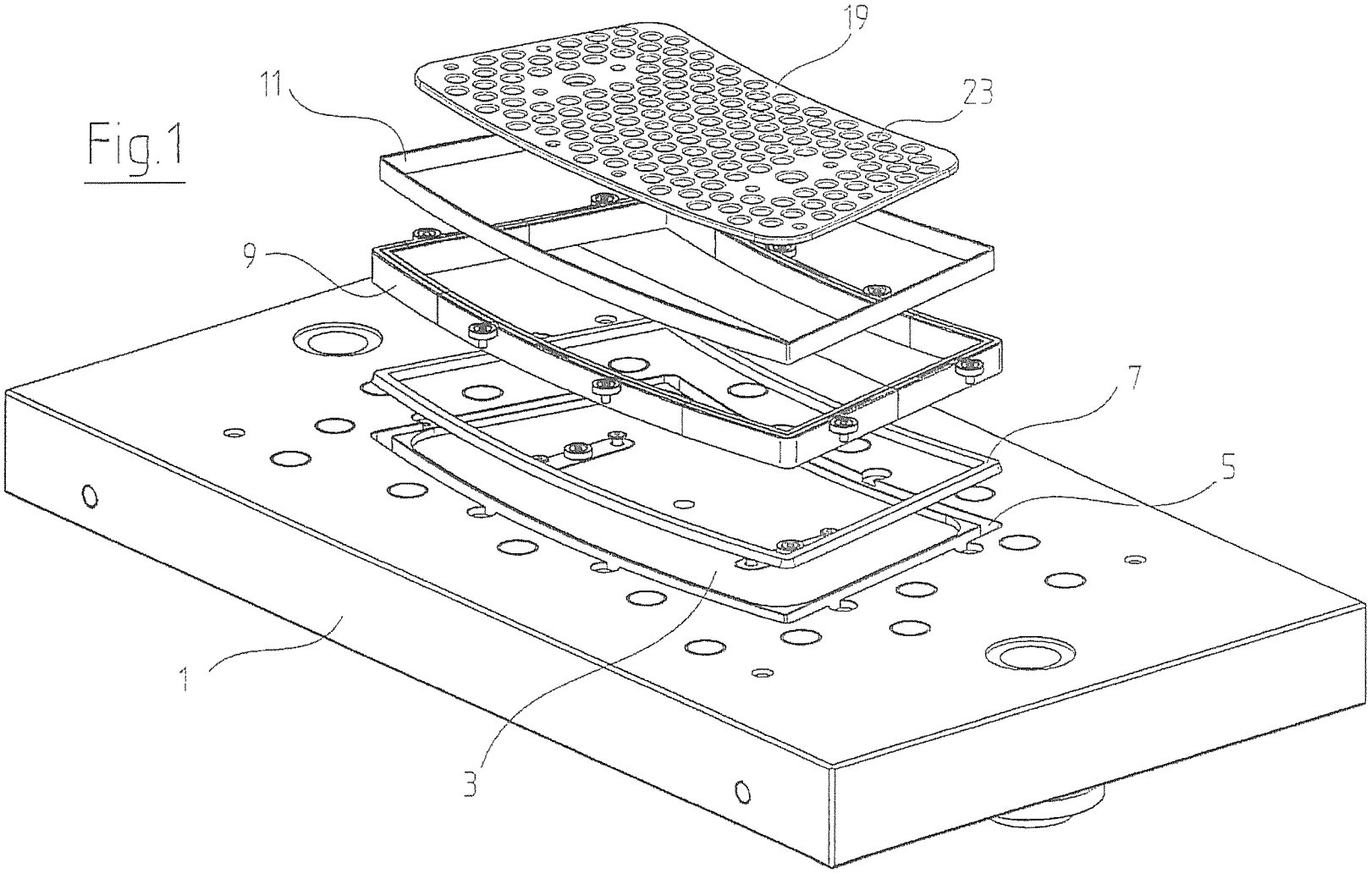
FIG. 1 an exploded illustration of a punching plate of a punching device with a punch blade and its support structure in the punching plate, viewed from the left, FIG. 2 a vertical section through the punching plate and the ejector, FIG. 3 an enlarged illustration of detail A in FIG. 2, FIG. 4 a view of the punching plate from the bottom with assembled cutting elements, FIG. 5 a perspective view of the punching plate, FIG. 6 a perspective illustration of a matrix plate from the top with matrix elements shown in an exploded illustration, FIG. 7 a top view of an assembled matrix plate, FIG. 8 a vertical section through a matrix plate, FIG. 9 an enlarged illustration of the detail D in FIG. 8, FIG. 10 an enlarged illustration of the magnetic fastener for the matrix plate according to FIGS. 6-9, and FIG. 11 a perspective illustration of another embodiment of the punching die (without punching plate) in a perspective exploded illustration from the bottom according to the Figure.
Figure 2:
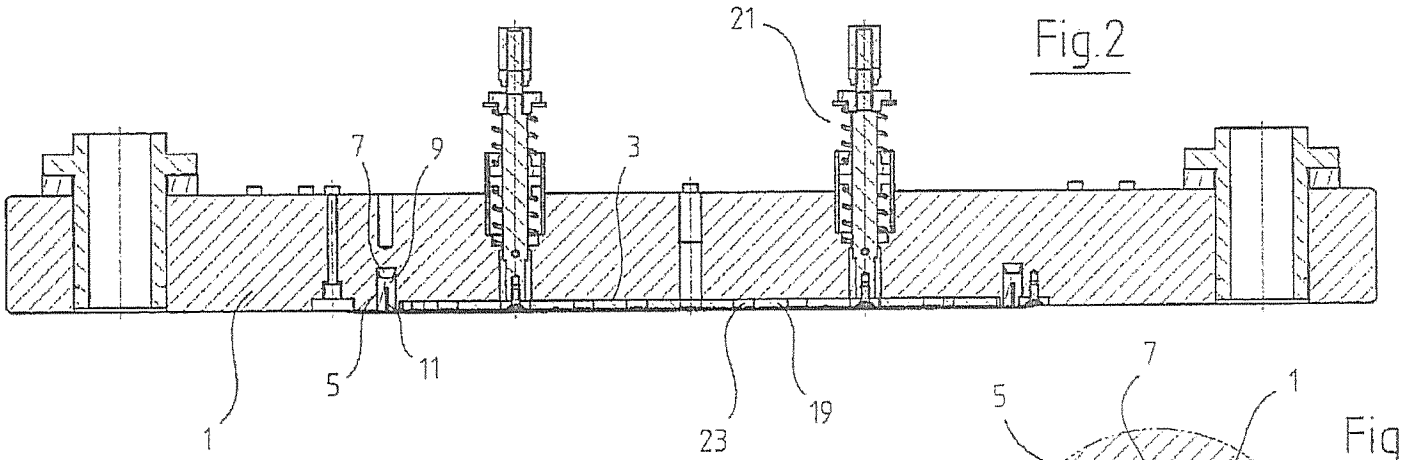
Figure 3:
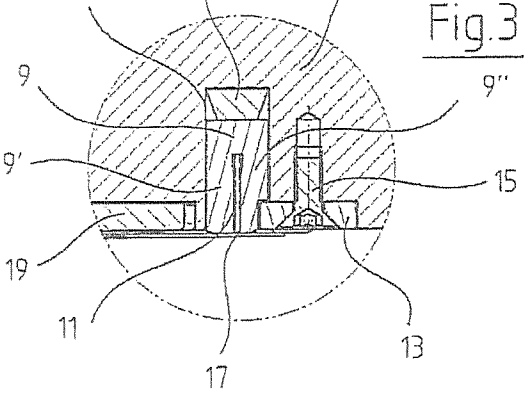
Figure 4:
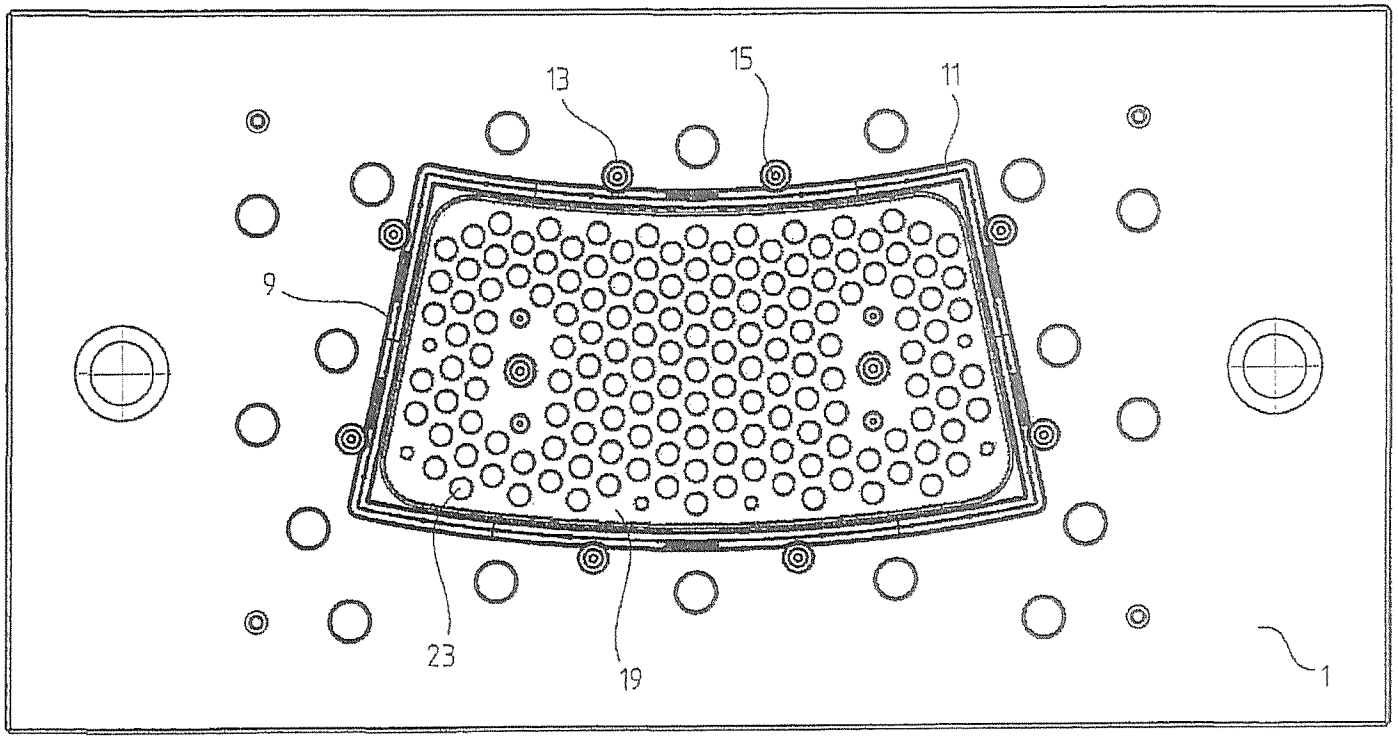
Figure 5:
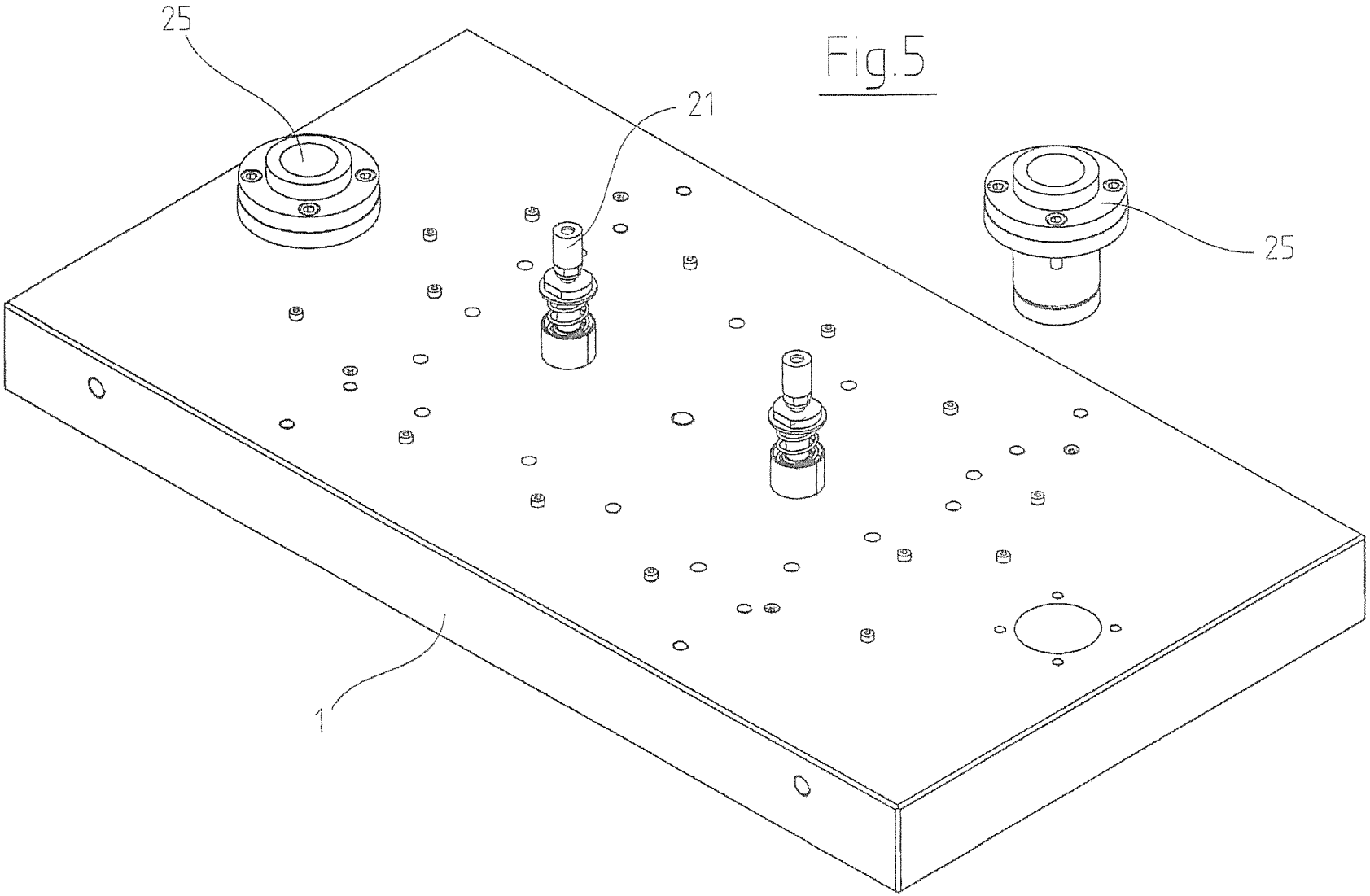
Figure 6:
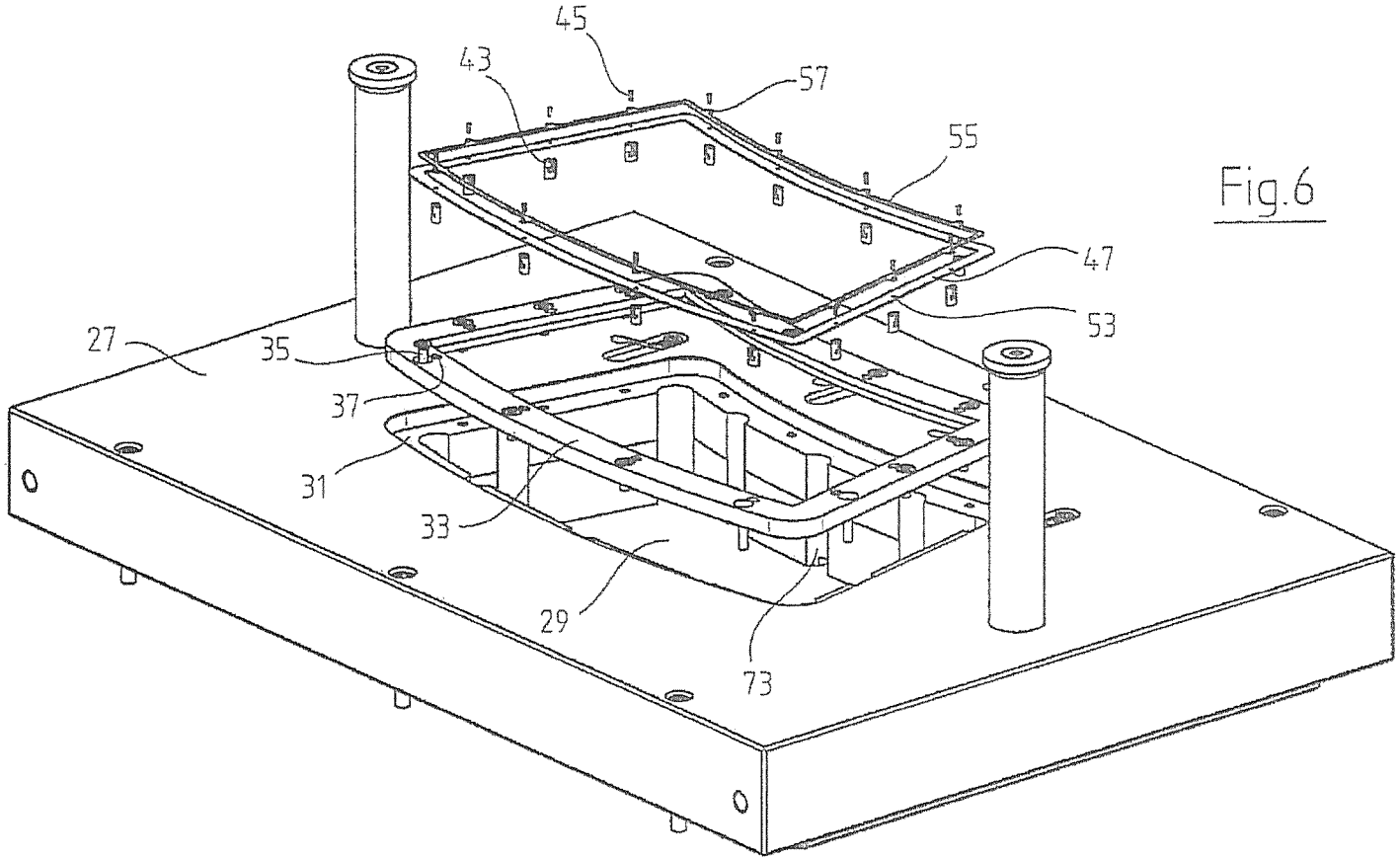
Figure 7:
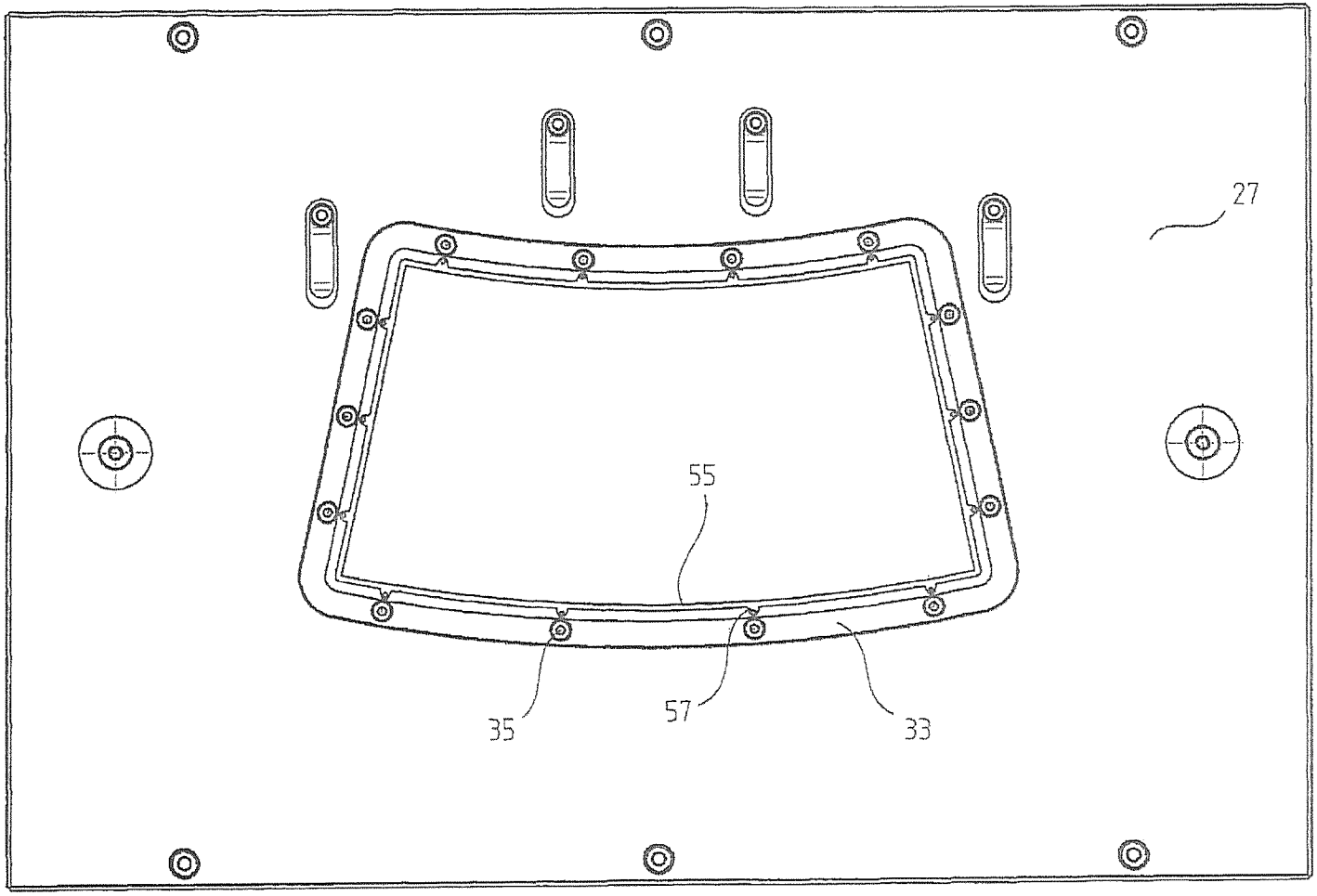
Figures 8, 9, 10:
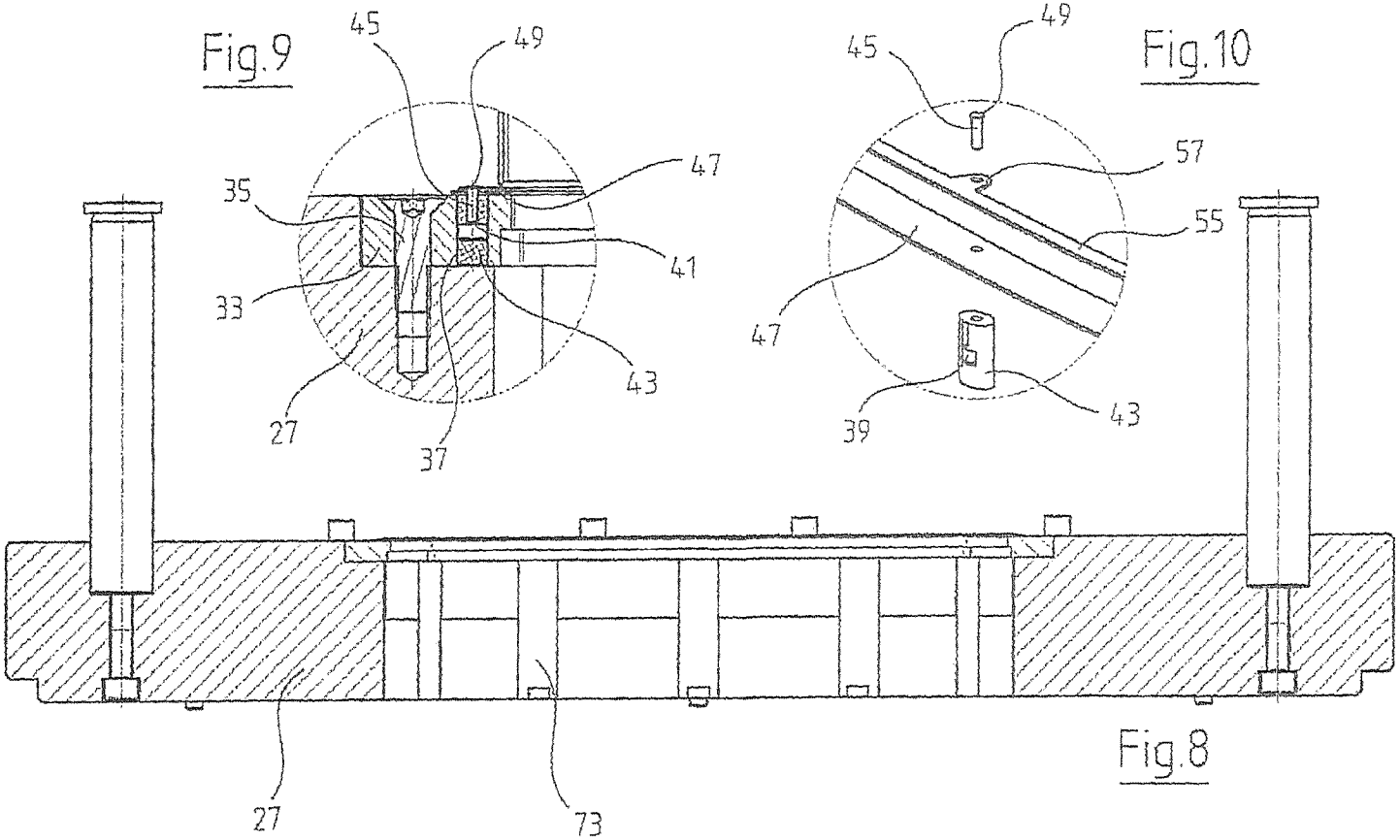

In FIG. 1, which shows the punching plate 1 in a perspective illustration from the bottom, a recess 3 is discernible in the central area, around which a groove 5 is inserted. The groove 5 serves for receiving a compensation element 7 and a blade holder 9. The blade holder 9 has, as shown in the cross-section, the shape of an upside-down "U". Further, a band steel blade 11 is discernible in FIG. 1. The band steel blade 11 is sized such that it can be inserted between the two legs 9', 9" of the blade holder 9, and is held there (also see FIGS. 2 and 3 for reference). It is also discernible from FIG. 3 that the compensation element 7 has a cross-section in a trapezoidal form. Further it is discernible that the blade holder 9 can be inserted precisely fitting in the groove 5 and can be connected by a fastening plate 13 and a screw 15 to the punching plate 1. The blade holder 9 is fixed in the punching plate via the fastening plate 13 and the screw 15. An arrangement of the fastening plates 13 is discernible in FIG. 4. The cutting edge 17 of a band steel blade 11 projects beyond the blade holder 9 by a few tenths of a millimeter. The facial areas of the legs 9' and 9" of the blade holder 9 project in turn beyond the bottom of the punching plate 1 by a few tenths of a millimeter. Further, an ejection plate 19 is shown in FIGS. 1 to 4, with its cross-section being smaller than the internal cross-section of the recess 3 in the punching plate 1 (cf. FIGS. 1 and 3). The ejection plate 19 preferably comprises a plurality of bores or holes 23 in order to avoid at the end of the ejection process any adhesion of the punched-out work piece due to a vacuum. The ejection plate 19 is actuated by at least one ejection device 21. The punched work piece is conveyed with this ejection device 21 from the punching plate 1 downwards into a stacking channel 73 (see FIG. 6). Any operation of the ejection device 21 can occur pneumatically or via a servo drive. The design of the ejection device 21 arranged at the rear of the punching plate 1 is not described in greater detail (see FIGS. 3 and 5). FIG. 5 shows the punching plate 1 from the top and thereon in turn a first and a second ejection device 21 are discernible. Further, the fastening elements for the punching plate 1 are discernible at a punching machine, not shown. These elements are not described in greater detail. Guide sockets 25 are drawn in the proximity of the two narrow sides of the punching plate 1 for a precise vertical guidance of the punching plate 1.

The FIGS. 6 to 10 show the matrix plate 27. The perspective illustration of the elements of the matrix plate 27 shows the latter in a view diagonally from the top. A penetrating opening 29 for the work pieces is discernible in the matrix plate 27. The edge of the penetrating opening 29 is embodied as a step 31. A matrix seat 33 rests on this step 31. The matrix seat 33 is fastened with screws 35 on the step 31 at the matrix plate 27. Bores 37 are formed in regular intervals at the matrix seat 33, which serve to receive respectively one permanent magnet 39 each (see FIGS. 9 and 10). Each permanent magnet 39 is here fastened locally fixed in a guide sleeve 43 provided for this purpose. The axial length and/or height of the permanent magnets 39 are sized such that a small clearance 41 develops between the top of the permanent magnets 39 and the bottom edge of the fastening pins 45. The fastening pin 45 comprises a flange 49 at its upper end.

An intermediate layer 47 comes to rest over the matrix seat 33. The intermediate layer 47 is made from a thin sheet metal, which comprises at the top and/or bottom a coating made from rubber or another rubber-elastic material. Alternatively the intermediate plate 47 could also be produced in its entirety from an elastic material. Bores 53 are provided in the intermediate plate 47, which are arranged directly above the bores 37 in the matrix seat 33. The bores 53 have a diameter which allows guiding fastening pins 45 through them with little play. A matrix 55 comes to rest above the intermediate frame 51. A flap-like bulge 57 is formed at the exterior edge of the matrix 55, in which a penetrating recess allows guiding the fastening pins 45, also called positioning pins. The bulges 57 are sized such that the flange 49 of the fastening pins 45 can rest on it. When all elements holding the matrix 55 are assembled, the matrix is pulled by the permanent magnets 39 and the fastening pins 45, made from steel, to the matrix seat 33 and/or the matrix plate 27 and held in place. By the elastic embodiment of the intermediate layer 47 the matrix 55 is held precisely in the horizontal plane (X/Y-direction), on the one side; in the vertical direction (Z-direction) it is slightly supported in an elastic fashion.

Figure 11:
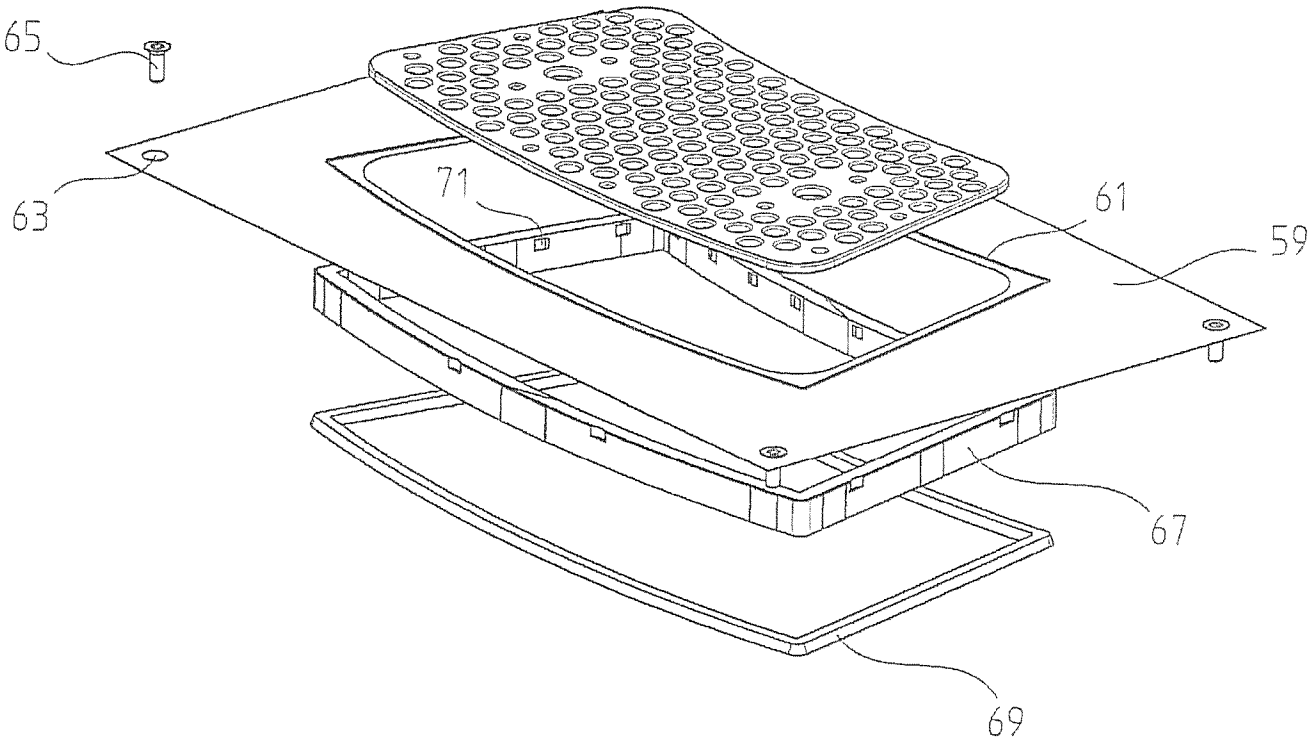

In another embodiment of the invention according to FIG. 11, instead of a band steel blade formed like a bead on the support plate 59, here a blade 61 is provided having a triangular cross-section. The support plate 59 comprises a thin metal sheet on which the blade 61, is applied for example as a bead made from a high-strength steel or a suitable steel alloy and by a cutting process has been turned into a blade 61. The support plate 59 comprises at least a bore 63 at its four corners, through which a positioning pin 65 each can be guided with little play and is held in the punching plate 1. The support plate 59 is located, similar to the first embodiment according to the FIGS. 1 to 5, in the area underneath the blade 61 on a support ring 67 or a support ring 67 with a magnet 71 inserted therein, which matches the first embodiment of the blade holder 9. The support ring 67 in turn rests on a compensating element 69.

The compensating element 69 matches the one with the reference character 7 of the first exemplary embodiment. The compensating element 69 and the support ring are held resting on the punching plate 1. The compensating elements 7 and 69 are made from plastic, e.g., polyurethane (PE). They carry the blades "in a resilient fashion".

In both embodiments of the invention the band steel blade 11 and/or the blade 61 are supported resiliently on the support plate 59 in the Y-direction, i.e. perpendicular to the surface of the punching plate 1. This embodiment allows and/or causes that during the punching process of a work piece, regardless if it comprises paper, metal, or a plastic film, the cutting force can be distributed evenly over the entire perimeter of the work piece. Any potential differences in thickness of the work piece or tolerances in the tool are here compensated by 100%. On the one hand, therefore the cutting process can occur with a moderate cutting force, which the punching machine can easily compensate, and on the other hand the cutting occurs securely along the entire perimeter of the work piece evenly and thus completely. Experiments have shown that the cutting force of elastically supported blades can be reduced by up to 90%.

The invention claimed is:

1. A device for punching thin-walled materials, comprising labels and flat lids for containers in small quantities, comprising a punching plate (1) for receiving a blade (11, 61); a matrix (55) on a matrix plate (27); wherein the blade (11, 61) and the matrix (55) are supported in a punching machine in a fixable and mutually displaceable fashion, in order to punch labels and lids comprising paper, plastic, metal, or a laminate from a material tape guided between the blade and the matrix; the matrix plate (27) comprising a recess (29) for guiding the punched out work pieces therethrough; a matrix seat (33) is fastened on an edge section of the matrix plate (27) abutting the recess (29);

an elastically deformable intermediate plate (47) rests on the matrix seat (33); and the matrix (55) rests on the intermediate plate (47).

2. The device according to claim 1, wherein the matrix (55) is guided without play in an X- and a Y-direction by fastening pins (45) and is held in a Z-direction, guided in an elastically displaceable fashion.

3. The device according to claim 1, wherein the matrix seat (33) is inserted and fastened in a step (31) surrounding the recess (29).

4. The device according to claim 2, wherein the intermediate plate (47) and the matrix (55) rest on the matrix seat (33) and are held by the fastening pins (45).

5. The device according to claim 4, wherein the fastening pins (45) are guided in guide sleeves (43) which are inserted in the matrix seat (33).

6. The device according to claim 5, further comprising magnets (39) inserted in the guiding sleeves (43) for pulling in the fastening pins (45) and holding the matrix (55).

7. The device according to claim 1, wherein the intermediate plate (47) is formed to be elastic in a direction perpendicular to a surface thereof and comprises a surface coated with an elastic material or is made in its entirety from an elastic material.

8. The device according to claim 1, wherein a second recess (3) is formed in the punching plate (1).

9. The device according to claim 8, further comprising a spring-elastic compensating element (7) inserted on a bottom of a groove (5) comprising the second recess (3).

10. The device according to claim 9, further comprising a blade holder (9) that is arranged in the groove (5) above the spring-elastic compensating element (7).

11. The device according to claim 10, wherein the blade holder (9) is formed U-shaped.

12. The device according to claim 11, wherein the blade holder (9) comprises a first and a second leg (9', 9"), with a band steel blade (11) being inserted between the legs (9', 9") of the U-shaped blade holder (9), and a cutting edge (17) of the band steel blade (11) projects beyond the blade holder (9).

13. The device according to claim 12, wherein the blade holder (9) in the groove (5) is elastically supported on the compensating element (7) and is held by holding elements (15) in the groove, which engage the punching plate (1).

14. The device according to claim 8, further comprising a compensating element (7) inserted on a bottom of a groove (5) comprising the recess (3).

15. The device according to claim 14, further comprising a magnetic blade support formed as a supporting ring (67) arranged in the groove (5) above the compensating element (7).

16. The device according to claim 15, further comprising a support plate (59) with a blade (61) embodied as a bead rests on the support ring (67) and is held by a magnetic support ring (67).

17. The device according to claim 16, further comprising a plurality of magnets (71) inserted in the support ring (67) by which the support plate (59) with the cutting bead (61) is held.

18. The device according to claim 1, further comprising at least one ejecting device (21) with an ejection plate (19) arranged at the punching plate (1) by which punched out work pieces are ejectable through the recess (29) in the matrix plate (27) into a stacking channel (73).

* * * * *